United States Patent [19]

Krouse

[11] Patent Number: 4,727,670

[45] Date of Patent: Mar. 1, 1988

[54] ELECTROMECHANICAL FIRING MECHANISM

[76] Inventor: Edwin E. Krouse, P.O. Box 4082, Owensboro, Ky. 42302

[21] Appl. No.: 912,787

[22] Filed: Sep. 29, 1986

[51] Int. Cl.[4] ..... F41C 19/12; F41C 17/08

[52] U.S. Cl. ..... 42/69.01; 42/70.01; 42/84; 89/28.1

[58] Field of Search ..... 42/69.01, 69.02, 69.03, 42/70.01, 84; 89/28.05, 28.1, 135

[56] References Cited

U.S. PATENT DOCUMENTS 2,935,001 5/1960 Buecker ..... 42/84 X

*Primary Examiner*—Deborah L. Kyle
*Assistant Examiner*—Ted L. Parr

[57] ABSTRACT

This invention concerns a unique firearm trigger, safety, and stock attachment mechanism and to an embodiment in a semi-automatic blowback rifle where the receiver is mounted in the buttstock, a style commonly referred to as a "bullpup". The trigger is a dual electrical and mechanical design with one trigger lever and a control timer. The safety is forward mounted and blocks the sear. The stock mounting prevents bending moments in the stock to be transmitted to the barrel/receiver assembly. The bull-pup rifle embodiment itself has several unique features including a cheekpiece removable from the stock.

7 Claims, 4 Drawing Figures

ELECTROMECHANICAL FIRING MECHANISM

BACKGROUND

This invention concerns the incorporation of a unique trigger, safety, stock attachment, and cheekpiece embodied in a rifle of the "bull-pup" style where the barrel/receiver assembly is mounted in the bullstock.

Trigger—The trigger is a capacitor loaded, solenoid driven electronic trigger with mechanical option, and an operator initiated control timer.

One feature of my trigger, the combination of an electrical and mechanical release, is similar to the Temple U.S. Pat. No. 2,780,882 with the difference being that my trigger allows the operator to choose between the electrical or mechanical release mechanism. Temple outlines in his patent a mechanical back-up for use in the event the electric trigger should fail. However, in actual practice, the back-up feature won't work. Temple did not allow for, or allude to, any overtravel mechanism to let the trigger lever continue past the point where the electric trigger switch is activated. This is a serious design problem. Temple's drawings show that attempting to use his mechanical back-up will drive his trigger lever into the electric trigger switch. This would damage the switch, the trigger lever, or both, and certainly affect the quality or "feel" of the mechanical trigger pull.

Temple himself was probably aware of this problem as he refers to the mechanical release as a back-up only and makes no claims or reference to having a feature to allow the operator to be able to select between the electrical and mechanical release mechanisms. It would have been to his advantage to make such a claim as it would eliminate the need for "set" trigger arrangements. Further, Temple's discussion of the operation of the mechanical back-up is very brief compared to the rest of his patent and as already observed does not address the overtravel problem.

As previously mentioned with my trigger the operator can select the electric release or the mechanical release mechanism. These are features that are similar to the "Electronic Set Trigger" Johnson/Badall U.S. Pat. No. 4,329,803, except my trigger uses no separate trigger button on the trigger lever and does not link the solenoid to the trigger lever.

As an added safety feature, my trigger has an operator initiated timer. When the operator selects the electric trigger function, a timer is started that will disable the electric trigger function if no shot is fired in a preset period of time, say 20 seconds. This prevents the sensitive electric trigger from remaining active should the operator forget that he has selected the electric option. No other trigger mechanism has this important safety feature.

Finally, for added convenience, my electric trigger resets its timing cycle if a shot is fired within the allowed period of time. Thus, making it ideal for firearms capable of rapid repeat shots.

Safety—The firearm safety is located forward of the receiver and, in this embodiment, part way down the barrel. This is similar to other patents with safeties located on a rifle forearm such as Anderson U.S. Pat. No. 2,380,140 which has buttons activating a device that blocks the trigger mechanism, and Fischer U.S. Pat. No. 2,819,550 that has a cable that must be continuously pressed to maintain the gun in the "fire" condition.

My safety is a sear blocking device unlike Anderson U.S. Pat. No. 2,380,140. A trigger blocking safety like Anderson's must be manufactured to precise tolerances when used with firearm triggers that have short pulls leading to discharge like my electronic trigger. A problem that is even further complicated when the trigger is adjustable. My sear blocking safety requires less manufacturing precision and is more secure than trigger blocking devices.

My safety has two stable positions, both "fire"and "safe", unlike Fischer U.S. Pat. No. 2,819,550. Safety mechanisms that require the shooter's non-trigger hand to be placed in a certain position on the gun to fire the gun, interfere with the shooter obtaining his most comfortable hold on the gun depending on the shooting stance and his personal preference. This markedly affects the ability of a shooter to reach his peak level of accuracy. Hence, unlike Fischer my forward mounted safety does not require constant shooter contact with the safety to maintain "fire" conditions.

The net effect is my safety provides for a secure, easy to manufacture, sear blocking design that does not require continuous contact by the shooter and is ideal for bull-pup and other applications.

Stock Attachment—When designing a rifle one of the problems faced by the designer is how to attach the receiver/barrel assembly to the stock so that torque applied to the stock is not transmitted to the receiver/-barrel assembly and thus affecting accuracy. Some rifle designs do not place a particularly high premium on accuracy hence there is not much concern about stock attachment. However, where accuracy is a concern, torque effects are controlled through such methods as free-floating the barrel, fiberglass bedding the barrel/-receiver, and using dimensionally stable synthetic or laminated stocks.

The stock torquing problem is especially acute in rifles of the bull-pup style. With the bull-pup's rearward mounted receiver there is the opportunity to have a longer bearing surface between the stock and the receiver/barrel assembly than with conventional designs. There is very little prior art associated with this problem in bull-pup designs other than the just "bolt-it-down" approach or the special receiver/pistol grip arrangement with synthetic stock enveloping the key components as used in Steyr's Austrian service rifle the AUG.

In my preferred embodiment the attachment mechanism is comprised of two points that allow rotation around each point and lateral displacement along a line parallel to the bore; thus isolating stock flexure from the barrel/receiver assembly. This is suitible to a wide variety of firearm designs not just a bull-pup.

Cheekpiece—The bull-pup rifle needs some method to isolate the shooter's face from the receiver for shooter comfort especially when the receiver is hot or cold. In the past this protection has either not been provided or it was integral with the stock. Disclosed herein is a cheekpiece protector that is removable from the stock so as to facilitate easy removal of the barrel/-receiver from the stock and to improve shooter comfort.

OBJECT OF THE INVENTION

The object of this invention is to create an accurate, comfortable rifle of the bull-pup style with operating conveniences allowing its accuracy potential to be easily realized by the shooter.

Another object is to provide a safe, reliable trigger mechanism where the shooter can select either a low operating force electronic release for the fire mechanism or a higher force, but still high quality feel, mechanical release. Both operating from the same simple trigger lever.

Another object is to improve safety by providing a timer that disables the electric trigger if not used in a preset period of time.

Another object is to provide the electronic trigger with the ability to reset itself after each shot like a typical mechanical system. This allows its use on firearms that can fire rapidly, such as semi-automatics, pumps, lever actions, etc.

Another object is to provide for a positive, sear locking safety mounted forward of the receiver, making it ideal for a bull-pup.

Another object is to provide a stock fastening mechanism that does not allow stock flexure to be transmitted to the barrel/receiver assembly, thus reducing the affect the shooter's grip can have on accuracy.

Another object is to provide various design features which make fabrication, assembly and final adjustments easy.

Other objectives and advantages will become apparent from the following description of a disclosed embodiment of the invention, and in the drawings.

Figure 1:
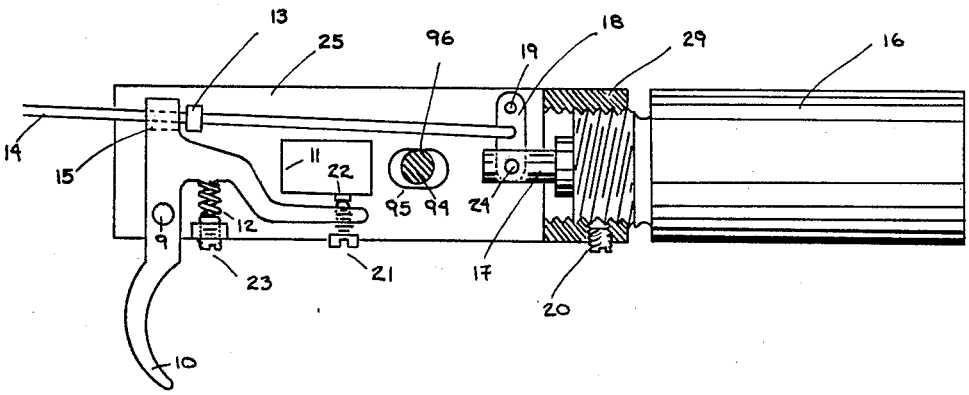
FIG. 1 shows a vertical view of the trigger housing that has one cover plate removed to expose the components, and is sectioned through the threaded collar holding the solenoid. It also shows the forward shock mounting pin.

The new inventions are described in the context of a bull-pup rifle with a substantially prior art firing mechanism of straight blowback semi-automatic design for 22 caliber rimfire cartridges. Prior art features will not be discussed except as necessary to clarify the operation of the new inventions.

It is to be understood that the inventions can be used in other embodiments and are not restricted to bull-pup semi-automatics. Further, in describing the embodiments of the inventions illustrated in the drawings, specific terminology will be resorted to for clarity. However, it is not intended to be limited to the specific terms so selected and it is to be understood that each specific term includes all technical equivalents which operate in a similar manner to accomplish a similar purpose.

DESCRIPTION OF OPERATION

Trigger—FIG. 1 illustrates the preferred embodiment for switch overtravel. One of the two trigger housing sideplates 25 has been removed for clarity. In operation switch 11 has a normally closed contact that is being held open by trigger lever 10 being urged into contact with the switch 11 by spring 12. As trigger lever 10 is rotated away from switch 11 around pin 9 the normally closed contact is allowed to close.

If the switch 11 is not electrically active the continued rotation of the trigger lever 10 about pin 9 would result in the trigger lever 10 contacting a stop 13 affixed to rod 14 running thru a slot 15 in the trigger lever 10, said rod 14 connecting to a disconnector 69 (FIG. 3*c*) of prior art design. Further movement will move the disconnector 69 forward and discharge the firearm in conventional fashion.

If the switch 11 is electrically active when the trigger lever 10 is pulled the switch 11 is made and a current is allowed to pass through the solenoid 16 pulling the core 17 of the solenoid 16. Core 17 having a slot to accept a lever 18 pivoting at pin 19 and attached to the rod 14. Vertical play in the hole in lever 18 that accepts core pin 24 accommodates the slight arc that lever 18 describes during operation. This particular embodiment provides for a mechanical advantage for the solenoid 16 through lever 18 but such mechanical advantage is not essential to other embodiments. When the core 17 pulls the rod 14 connected to the disconnector 69 the stop 13 is pulled away from the trigger lever 10 hence the trigger lever 10 has no mechanical connection to the disconnector 69.

Adjustments to take up slack between disconnector 69 and the core 17 are provided by screwing the solenoid body 16 in or out of its threaded mount 29 as required and locking in position with set screw 20.

Adjustments to the relationship between the electric switch 11 and the rod stop 13, to the trigger lever 10 are made through screw 21 that is threaded through the trigger lever 10 and provides the surface that touches the switch activating button 22.

Adjustments to the weight of the trigger pull are made through screw 23 acting on spring 12.

Figure 2:
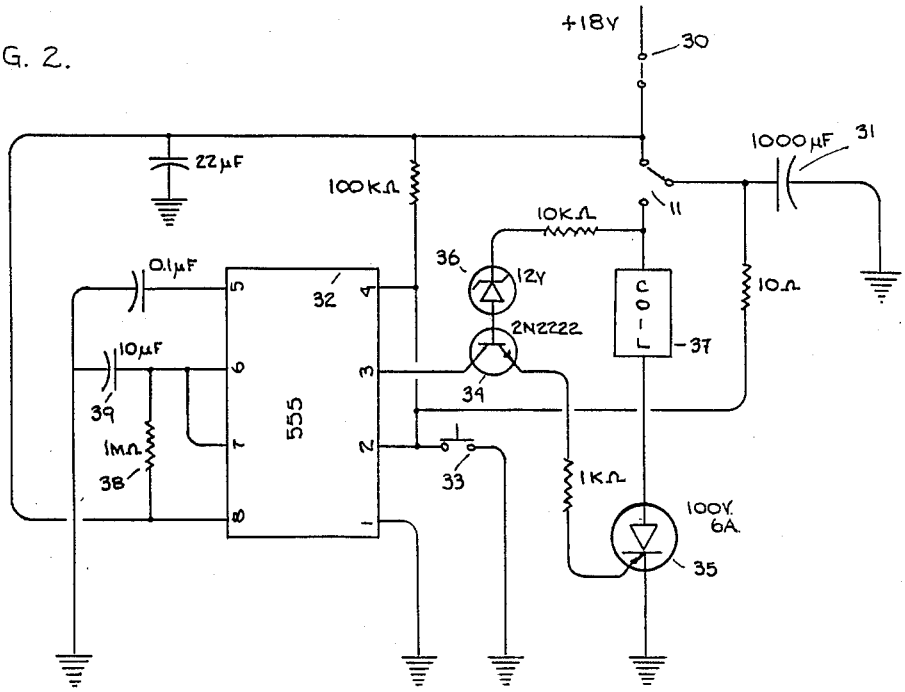
FIG. 2 is a schematic of the electronic trigger circuit.

Electric Circuit—FIG. 2 illustrates the preferred embodiment of a circuit to provide timing functions and to control the electric current to power solenoid 16. When the circuit is made active by switch 30 a capacitor 31 charges to the battery supply voltage of 18 volts and an integrated circuit timer 32 is powered up. The timing cycle is initiated upon activation of momentary switch 33. Only when the timing cycle is in progress is there power out from pin 3 to transistor 34. When the trigger lever 10 allows the double pole single throw switch 11 to complete the circuit between the capacitor 31 and the SCR 35 the transistor 34 is turned on if there is at least 12 volts on the capacitor 31 as detected by Zener diode 36. If the 12 volts is present and IC 32 pin 3 output indicates the timing cycle is in progress then current passes to the gate of SCR 35 allowing the full capacitor 31 charge to flow through the coil 37 of solenoid 16. When the capacitor 31 goes low on voltage it pulls IC 32 pin 4 and 2 to low voltage re-initiating the timing cycle. After the capacitor 31 is fully discharged the SCR 35 shuts off. When the trigger lever 10 is released, switch 11 returns to its rest position recharging the capacitor 31.

The timing cycle is a function of resistor 38 and capacitor 39. A typical cycle of 20 seconds would be obtained by values of 1 megohm and 10 microfarads respectively.

Note that with this circuit if the trigger lever 10 is pressed when the momentary switch 33 is pushed the gun does not fire as the capacitor 31 dumps through the switch 33 not through the coil 16.

Other features can be added to this circuit such as a switch in conjunction with the mechanical safety without changing the basic function.

Figure 3:
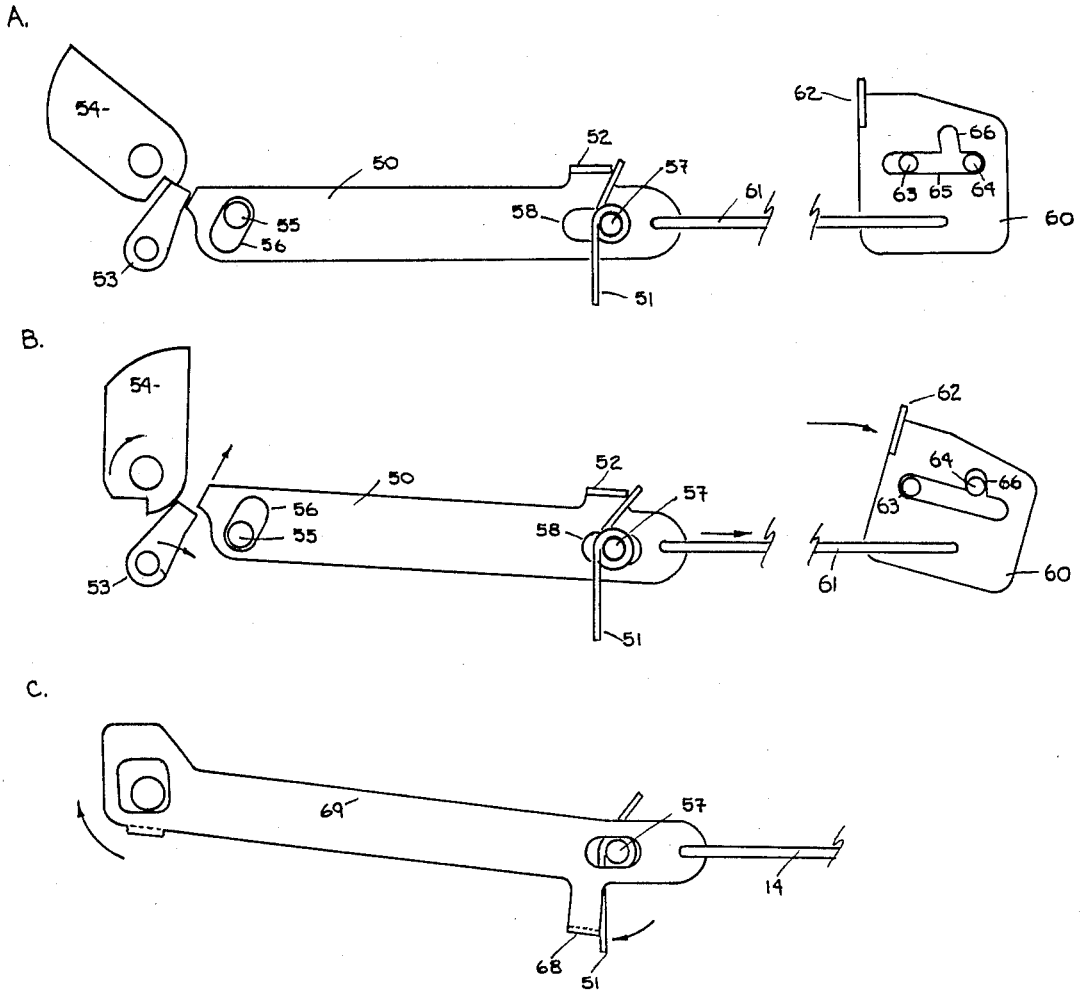
FIG. 3 shows vertical views of the safety mechanism in both the "safe" and "fire" positions, it also shows the relationship between the safety and disconnector through the torsion spring.

Safety—In FIG. 3*a*, the safety bar 50 is shown urged into the "safe" position by torsion spring 51 pressing on safety bar tab 52 thus blocking the sear 53 from moving to release the hammer 54.

Figure 4:
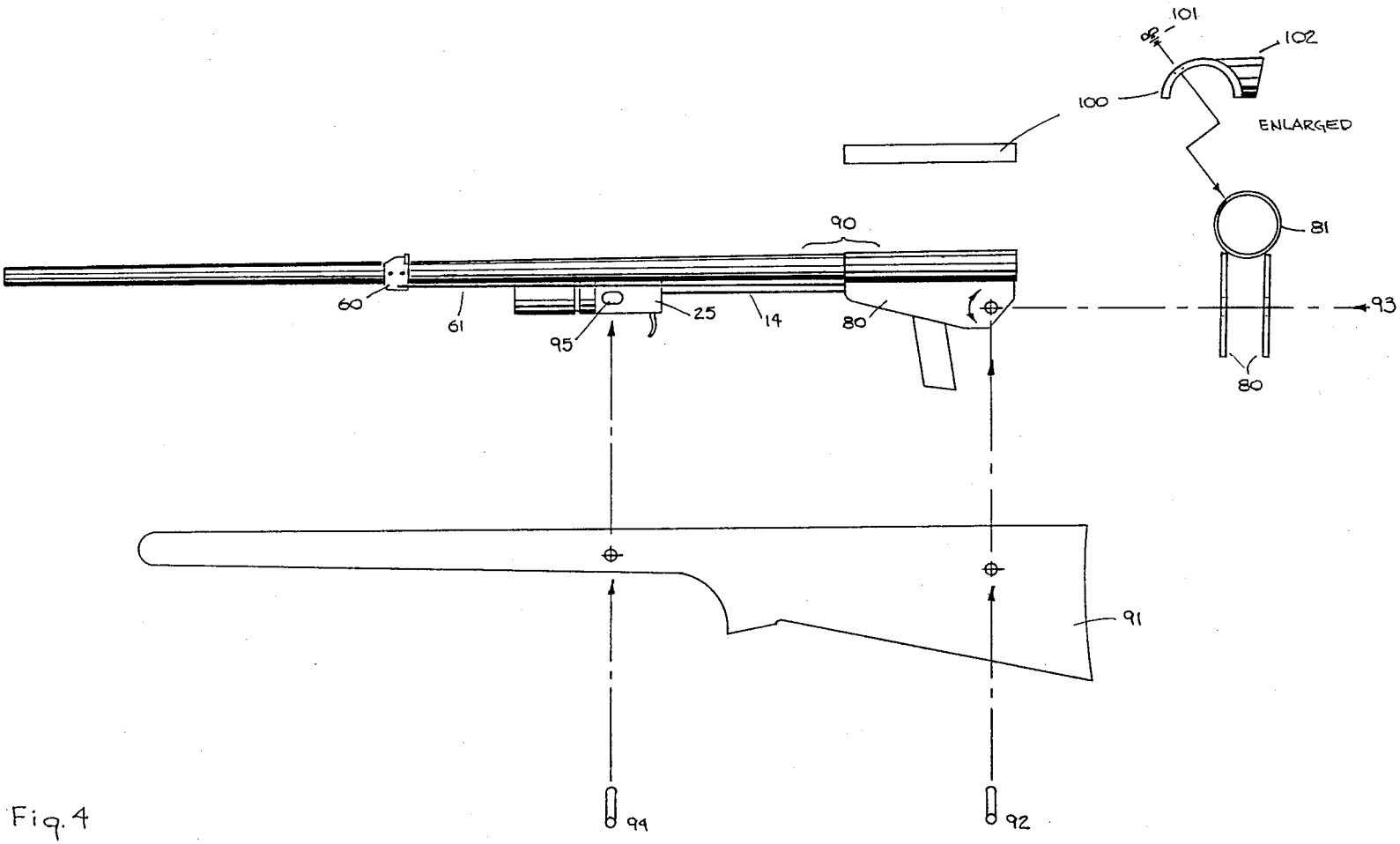
FIG. 4 shows vertical views of the general layout of the barrel/receiver attachment to the stock and the cheekpiece.

In the following description the hammer 54 and sear 53 pivot pins as well as safety bar 50 piins 55 and 57 are fixed in the firearm action housing 80 (FIG. 4); and actuating member 60 pins 63 and 64 are fixed on the barrel 90 (FIG. 4).

If force is applied to the sear 53 in an attempt to disengage the hammer 54 that force is transmitted to pin 55 through the safety bar 50. The pin 55 is located roughly tangent to the arc described by the sear 53 where it touches the hammer 54. This prevents the generation of any component of force that would try to urge the safety bar 50 up along slot 56. Rotation around pin 55 is prevented by pin 57 in slot 58.

In FIG. 3*b*, the safety bar 50 is pulled into the "fire" position by the operator pushing the actuating member 60 forward pulling with it the connecting rod 61 and the attached safety bar 50. When the safety bar 50 is moved thus forward it also slides up slot 56 freeing the sear 53 to move.

The safety bar 50 is held in the fire position against torsion spring 51 by the actuating member 60. When the operator pushes the actuating member 60 forward at tab 62, it is guided by pins 63 and 64 in slot 65. When it reaches a point where pin 64 can move into slot path 66 then actuating member 60 rotates around pin 63 urged by the safety bar spring 51 and operator pressure at tab 62. Thus restraining the safety bar 50 in the fire position under tension of spring 51.

The safety bar 50 is returned to the safe position by the operator pressing downward and rearward at tab 62 rotating actuating member 60 about pin 63 allowing torsion spring 51 to return safety bar 50 to the the safe position. This mechanism allows the firearm to be put on "safe" even when the firearm is not cocked; then when firearm is cocked the safety bar 50 will be immediately urged into position blocking the sear 53.

In FIG. 3*c*, the other arm of the torsion spring 51 is shown pressing against the tab 68 of disconnector 69 urging disconnector 69 upward and to the rear thus spring 51 provides the proper urging forces for both the new invention safety and a mainly prior art disconnector.

Stock Attachment—FIG. 4 illustrates the preferred method for mounting the barrel/receiver assembly 90 to the stock 91 while isolating it from any torque applied to the stock 91. The stock 91 bears on the barrel/-receiver 90 at only two pins. The rear pin 92 passes in close fit through the action box sideplates 80 and the stock 91, providing a pivot that allows the barrel/-receiver 90 to rotate on the axis 93.

In FIG. 4 and FIG. 1 the front pin 94 passes through a slightly oversize slot 95 in one of the trigger sideplates 25 and passes through but does not touch the other trigger sideplate. The pin 94 is in close fit and bears on the stock 91 on both sides of the trigger sideplate 25. Some rotation can occur on all axis around the point 96 where the pin 94 contacts the trigger plate 25, and longitudinal movement is permitted in the direction of the slot 95 parallel to the barrel bore centerline.

The two pins 92 and 94 acting together hold the barrel/receiver assembly 90 in the stock 91 but permit the stock to be flexed within the normal range of motion achieved by a shooter gripping the weapon without transmitting the torque to the barrel/receiver 90.

Other methods allowing pivoting at both mounting points and longitudinal motion at at least one point are equivalent. This would include schemes such as using mounting screws that slide in slots parallel to the barrel bore centerline, using elastic materials at one or both mounting points, or using mounting techniques where "play" at the mounting points provides the necessary rotational and longitudinal freedom.

Cheekpiece—FIG. 4 illustrates a cheekpiece 100 that insulates the shooter's face from the receiver 81 and is removable from the stock 91 with the receiver 81.

In this embodiment the cheekpiece 100 is molded from any suitable plastic material and is mounted to the receiver 81 with screws 101. This embodiment also shows an optional integral ejection port sheild 102.

Other embodiments could include a cheekpiece removably mounted to the stock and designed to simulate a conventional raised cheekpiece with a portion to wrap up over the receiver.

It is to be understood that the form of the invention herewith shown and described are to be taken as the preferred embodiments. Various changes may be made in the shape, size, and arrangement of parts, for example: equivalent elements may be substituted for those illustrated and described herein, parts may be reversed and certain features of the inventions may be utilized independently of the use of other features all without departing from the spirit or scope of the inventions as defined in the subjoining claims.

What is claimed is:

1. A trigger mechanism for a firearm including a firing mechanism to discharge the firearm, said firing mechanism being activated in response to the operation of a trigger, the improvement comprising:

a timing means to disable said trigger mechanism after a specified period of time if the firearm is not discharged within said specified period of time, and a means for automatically restarting said timing means if the firearm is discharged within said specified period of time.

2. A trigger mechanism according to claim 1 wherein said timing means operates electrically.

3. A trigger mechanism according to claim 2 wherein said timing means includes solid state circuitry.

4. A trigger mechanism according to claim 1 wherein the firing mechanism includes electrical means to discharge the firearm.

5. A trigger mechanism according to claim 4 wherein the firing mechanism includes mechanical means to discharge the firearm as an alternative to said electrical means.

6. A trigger mechanism according to claim 4 wherein said electrical means includes a solenoid and a capacitor for supplying current to said solenoid.

7. A trigger mechanism according to claim 1 including a manual switch for initiating said timing means.

* * * * *